United States Patent [19]

von Lersner

[11] Patent Number: 4,627,475

[45] Date of Patent: Dec. 9, 1986

[54] PRODUCT-DISPENSING APPARATUS

[75] Inventor: Wolf A. von Lersner, Cherry Hill, N.J.

[73] Assignee: Campbell Soup Company, Camden, N.J.

[21] Appl. No.: 768,352

[22] Filed: Aug. 22, 1985

[51] Int. Cl.[4] ..... B65B 3/04

[52] U.S. Cl. ..... 141/107; 141/186; 141/258; 92/52; 92/65; 222/135; 222/386

[58] Field of Search ..... 92/52, 65; 222/135, 222/386; 141/100–110, 234–245, 250–284, 129–191

[56] References Cited

U.S. PATENT DOCUMENTS 2,793,838 5/1957 Painter ..... 222/135

4,496,033 1/1985 Hall et al. ..... 92/52

*Primary Examiner*—Houston S. Bell, Jr.

*Attorney, Agent, or Firm*—Albert L. Free

[57] ABSTRACT

Apparatus for filling containers with two products from different sources, using a rotating volumetric filler which picks up first one product then the other, and discharges them both simultaneously into a container. The filler uses a pair of concentric pistons, the central one of which is retracted to pick up the first product as it rotates over an arcuate slot beneath which the first product is stored; the outer, cylindrical piston is then retracted to pick up the second product as it rotates over another arcuate slot beneath which the second slot is located. Both pistons are later extended simultaneously to discharge the combined product into the container. Since the two products picked up by the successive retractions of the two pistons are held beside each other, a more uniform mixture of the two products is obtained than if they are picked up one above the other by a single piston.

5 Claims, 9 Drawing Figures

PRODUCT-DISPENSING APPARATUS

This invention relates to apparatus for dispensing product, and especially to apparatus for dispensing food product into containers.

BACKGROUND OF THE INVENTION

There are a variety of situations in which it is desired to dispense product automatically and in controlled quantities, for example into a container. In one type of such situation which will be described in detail hereinafter, it is desired to dispense a plurality of component food product into containers for ultimate sale to a consumer.

It is known to fill each of a train of rapidly-moving containers, such as cans or jars, with an accurately metered quantity of product from a single product source, by means of a volumetric filler. Such volumetric fillers are also known which take two or more separate food components from a corresponding number of sources of food product in sequence, and then dispense the several components sequentially into each container. U.S. Pat. No. 3,731,715 of L. M. Gageant and W. L. Greet, issued May 8, 1973 describes and claims such a volumetric filler, in which a movable chamber and piston arrangement first picks up a first component product from a supply source for that product as the piston is retracted, and then moves to another position at which the piston is retracted still farther to pick up a second component product, beneath the first product in the chamber; the piston-and-chamber arrangement is then moved to still another position, where a container is presented beneath the chamber and the piston is extended to discharge the two products sequentially into the container.

Difficulties arise in such system when it is deemed important to provide in each container a substantially homogeneous mixture of component products, the mixture being substantially the same for each container. One approach to this problem which has been tried is to place the product components, in accurate relative proportions, into a mixer from which the dispenser draws its product. While this tends to assure that substantially proper proportions are dispensed on the average, the mixing process does produce a random distribution of components throughout the mixture such that there is some appreciable variation in relative proportions of components in any given sample, the variations from the average being approximately according to a bell-shaped Gaussian distribution curve; thus different containers, and different comsumers, may receive slightly but significantly different proportions of ingredients. Also, where the product comprises a low-viscosity carrier and relatively large particles of other components, some settling of the large particles may also occur in the supply passage extending from the mixer chamber to the intake of the volumetric filler. These and similar factors have had sufficient effect that if, for example, one of the component products comprises a large-particle garnish such as small balls of meat or mushroom slices, there may be a difference amounting to at least several pieces of garnish between the contents of different containers, which is undesirable for obvious reasons.

If, on the other hand, one uses a filling system such as that of the U.S. Pat. No. 3,731,715 which dispenses the various components into each container sequentially, then while substantially the proper relative proportions may be dispensed, undesirable layering may occur, and when a relatively viscous component is present in the composite product such layering may be quite pronounced. By "layering" is meant that one or more component products remain in a layer distinct from the rest of the product in the container, and a homogeneous mixture of product in the container is not achieved. This not only produces a "separated" appearance, which is often deemed undesirable by the consumer, but in general will result in significant non-homogenity of the product when it is poured or otherwise removed from the container for use. While violent and/or prolonged shaking of the container just before use of the product can tend to homogenize the distribution of the several fractions or components of the product, to require such shaking is very undesirable from the viewpoint of consumer acceptance, and does not overcome the undesirable separated or layered appearance of the product during storage, which is especially objectionable when the container is transparent.

Accordingly, an object of this invention is to provide a new and useful product dispensing apparatus.

Another object is to provide such apparatus which takes a plurality of different component products from different sources and dispenses them as a substantially homogeneous mixture.

It is also an object to provide such apparatus in which the dispensed product is not only substantially homogeneous but also contains said component products in accurately predetermined proportions.

A further object is to provide such apparatus which is adapted to accurate, high-speed dispensing into rapidly moving containers.

SUMMARY OF THE INVENTION

These and other objects of the invention are attained by the provision of dispensing apparatus comprising a main cylinder chamber and a plurality of parallel, preferably concentric pistons therein, the number of pistons preferably equalling the number of sources from which component products are to be drawn. Each piston is separately reciprocable along the axis of the chamber, and one end of the chamber is moved sequentially adjacent and into communication with the several sources of component products. The pistons are retracted sequentially in synchronism with the lateral movement of the chamber, in such manner that when end of said chamber has moved into communication with one of said sources, the retraction of a corresponding one of said pistons vacates a volume of said chamber which then becomes filled with component product from that source. The volumes of the main chamber thus sequentially filled are positioned beside each other transversely of the chamber, rather than one above the other as in the prior art volumetric filler. After each component product has thus been taken from each source and transferred into said chamber, the chamber end is moved to a product-dispensing position with said pistons still retracted and said compoment products still held within said main chamber; at said dispensing position, all of said pistons are preferably moved simultaneously outwardly to discharge the several component products substantially simultaneously from said end of said chamber.

Since all component products are preferably discharged substantially simultaneously, and at the same level, undesired layering is eliminated; and, since the amount each product component is in effect metered in accordance with the pre-set amount of retraction of each piston, the exact relative proportions of the component products are also provided in the discharged composite product.

Preferably, the innermost or central piston is closed at its forward end and is the first to be retracted, and the one or more other pistons are hollow cylinders the inner walls of which serve as the outer sub-chamber walls for the next innermost piston. In this embodiment, in which there are no fixed walls between the pistons, there is the further advantage that substantial intermixing of the component products with each other will normally occur in the chamber during each cycle of retraction and subsequent forward motion of the pistons, contributing to the homogeneity of the final component product.

In a preferred embodiment of the invention, in essence the type of volumetric filler shown in the above-cited U.S. Pat. No. 3,731,715 is modified by replacing each single-piston filling chamber with the concentric multi-piston filling chamber of the present invention, with the pistons controlled to achieve the advantages of homogeneity and accuracy of proportions described above.

BRIEF DESCRIPTION OF FIGURES

These and other objects and features of the invention will become more readily apparent when taken with the accompanying figures, in which.

DESCRIPTION OF PREFERRED EMBODIMENTS

Without in any way limiting the invention, it will be described in the interest of definiteness with particular regard to a specific embodiment using the general type of volumetric filler shown and described in the above-mentioned U.S. Pat. No. 3,731,715, as it may be employed to combine a tomato-based spaghetti sauce containing only small particles, with sauce containing a large-particle garnish such as small balls of meat or slices of mushrooms having, for example, a maximum dimension of about ¼ inch.

The large-particle sauce may be stored in the supply hopper 10, and the tomato sauce containing only small particles in supply hopper 12. The purpose of the apparatus shown, then, is to take a predetermined amount of component product from each of the hoppers and dispense it simultaneously and at the same level into each of a train of jars such as 14, moving continuously and rapidly through the filler.

The general mechanical construction and operation of the filler and the jar conveyor may be as shown and described in the above-cited patent and hence are not described herein in detail, the disclosure of that patent being included herein by reference. As noted above, the primary difference between the present embodiment of the invention and the apparatus of the cited patent lies in the construction and operation of the contents of the individual filling chambers and in the nature of the cams and cam followers which control the motions of the pistons in the chambers.

Figure 2:
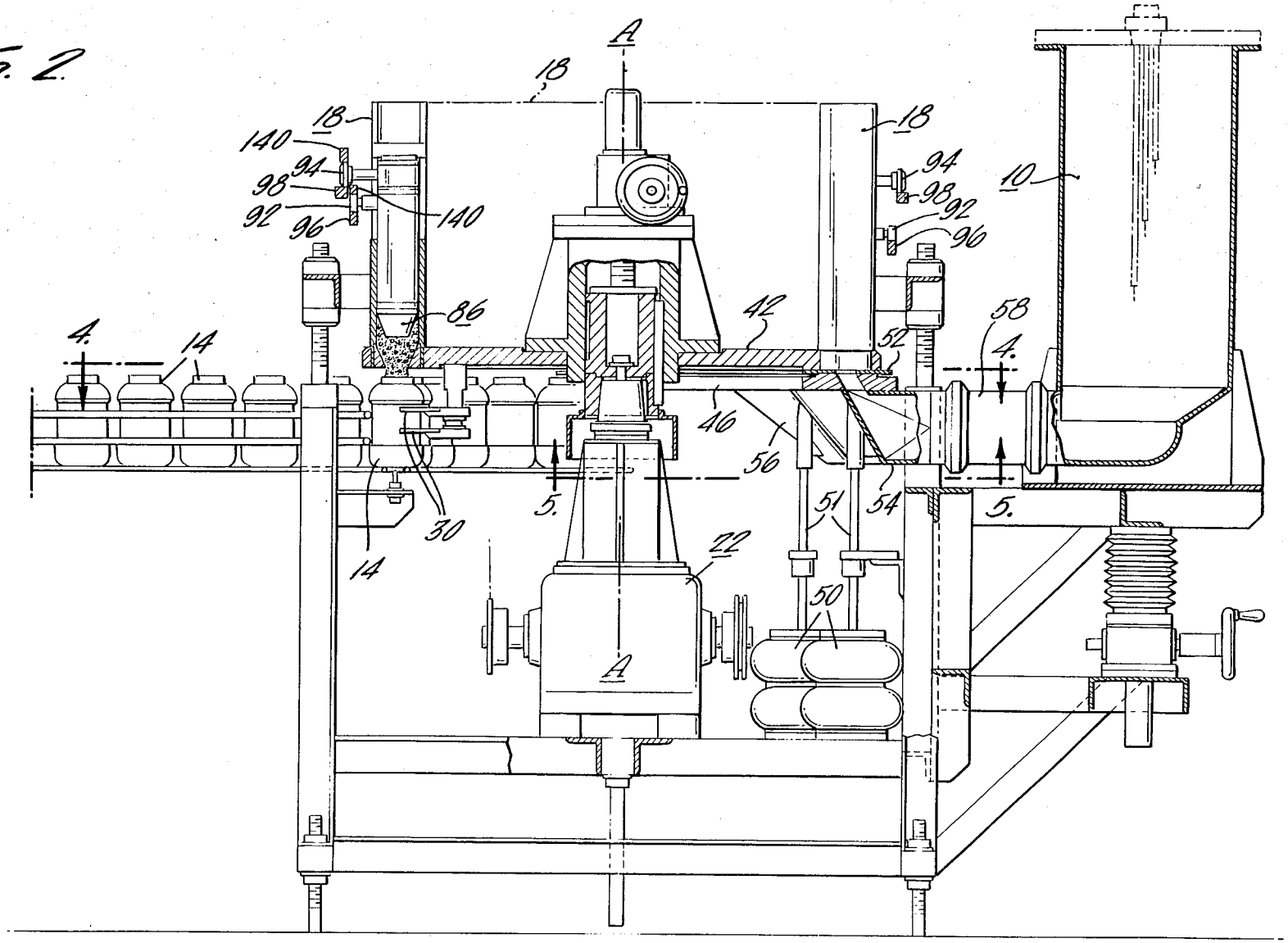

In general, the complete system shown comprises a volumetric filler including a plurality of filler cylinders 18 arranged in a ring around a vertical axis A about which they are rotated at a constant rate by a conventional drive means, including motor M (FIG. 4), transmission 22, and appropriate chains and sprockets. The jars 14 are brought to the filler by a conventional screw conveyor 24 and, by means of a star wheel 26, transferred onto the lower run of the rotary conveyor where they are pushed along by pusher fingers such as 30 (FIG. 2), one jar below each of the corresponding filler cylinders. After being filled with the two food products, the jars are transferred from the filler to the exit conveyor 34 by another star wheel 38, for subsequent processing. The drives for the conveyor and filler are of course suitably synchronized to provide this operation.

The lower ends of the rotating filler cylinders are provided with bottom openings such as 40 (See FIG. 6) which constitute the inlet and discharge orifices therefor, and which terminate in the correspondingly-rotating annular product feed plate 42. Below the part of the feed plate 42 not occupied by the jars is a part-annular non-rotatable filler table 46 which is spring tensioned upwardly, as by ordinary springs or preferably by air springs such as 50 (FIG. 2) acting through vertical support rods such as 51, so as to be urged upwardly toward the lower side of the feed plate as the feed plate rotates above and against it. Preferably, as shown, a smooth low-friction plastic cover plate 52 overlies and is secured to the stationary filler table so that the pressure between the cover plate and feed plate maintains an appropriate seal between feed plate and cover, without producing excessive braking action.

Figure 4:
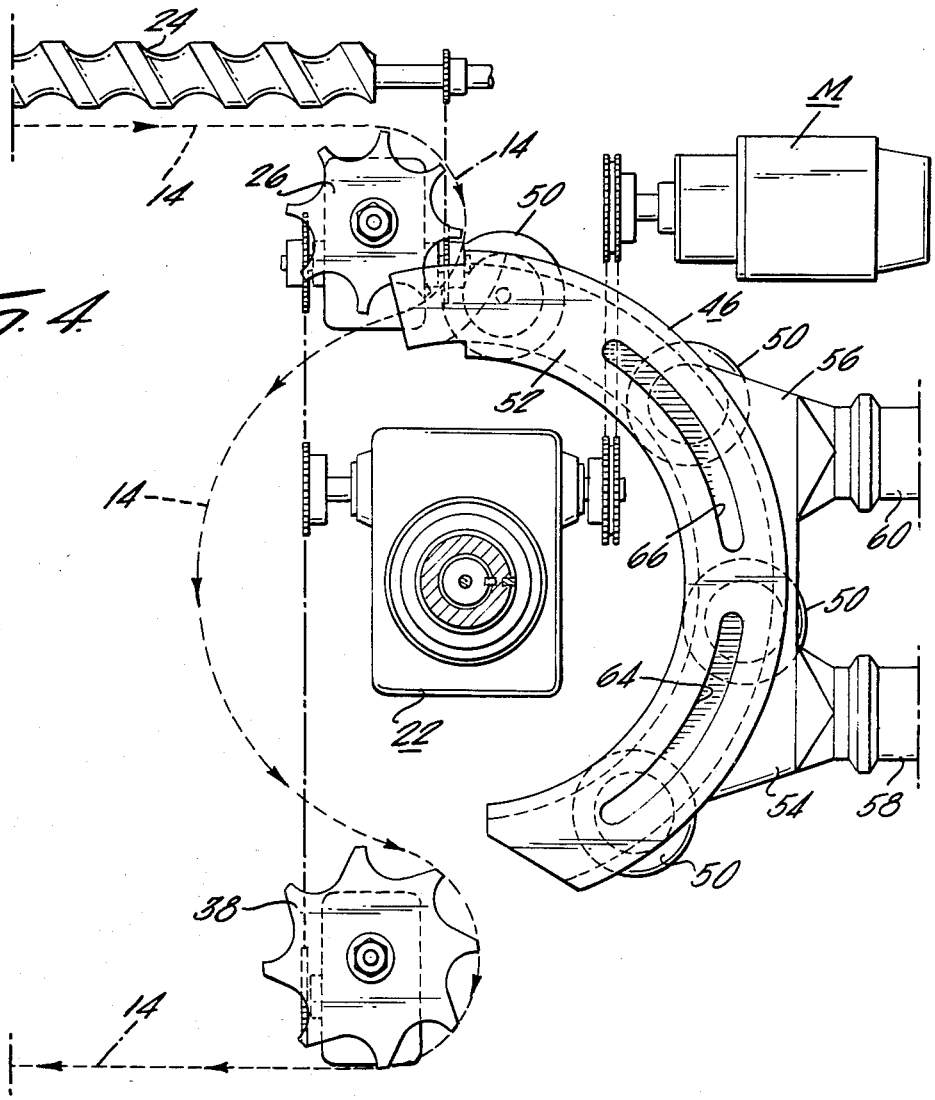
FIG. 4 is a top plan view, taken on lines 4—4 of FIG. 2, of the apparatus of FIG. 1, with the upper rotating portion removed to show the filler plate and the slots through which food produced is withdrawn into the cylinders rotating above them.
Figure 5:
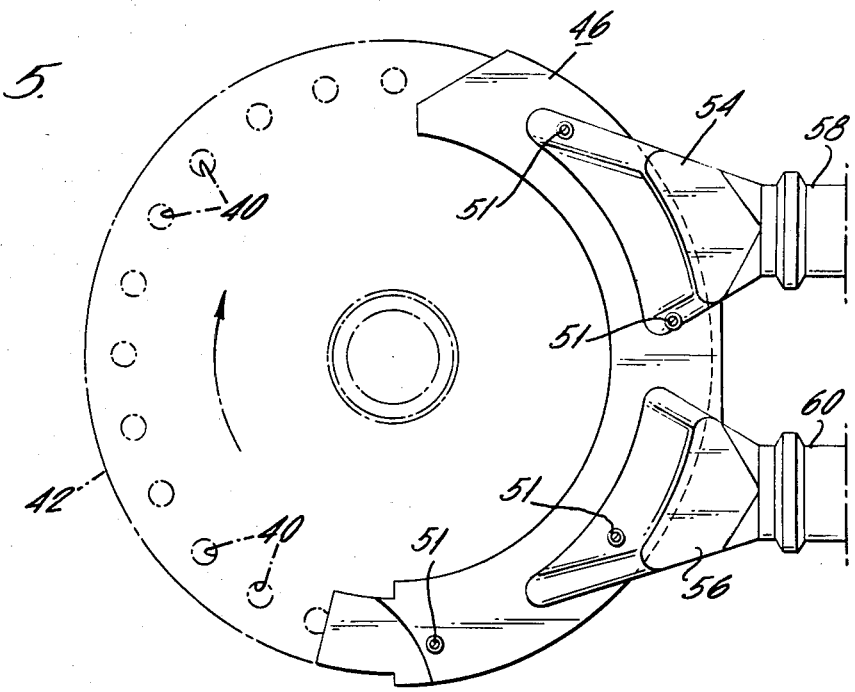
FIG. 5 is a bottom plan view taken along lines 5—5 of FIG. 2, showing the underside of the filler plate and the two feed chambers from which the two food products are withdrawn by the cylinders rotating above them.
Figure 7:
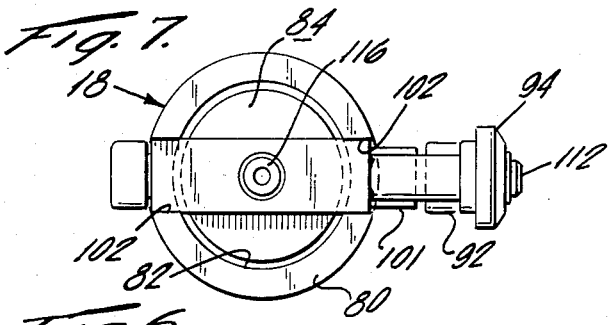
FIG. 7 is a top plan view of the piston and cylinder arrangement of FIG. 6.

The bottoms of the supply hoppers 10 and 12 communicate with the product supply chambers 54 and 56 (FIG. 5) located beneath the filler table 46, by way of conduits 58 and 60, respectively, and terminate at the filler table in respective arcuate openings 64 and 66 (FIG. 4). Accordingly, as the feed plate and the filler cylinders attached to it rotate, the lower open ends of the cylinders communicate with the arcuate openings of the product-supply chambers 54 and 56 as they pass over the arcuate openings 64 and 66; by successively retracting the two pistons in the filler chambers upwardly as they pass over these arcuate openings, component products from the two chambers are sequentially transferred upwardly into the interiors of the filler cylinders, in predetermined quantities determined by the volumes of the cylinders exposed by retraction of the pistons.

Figure 8:
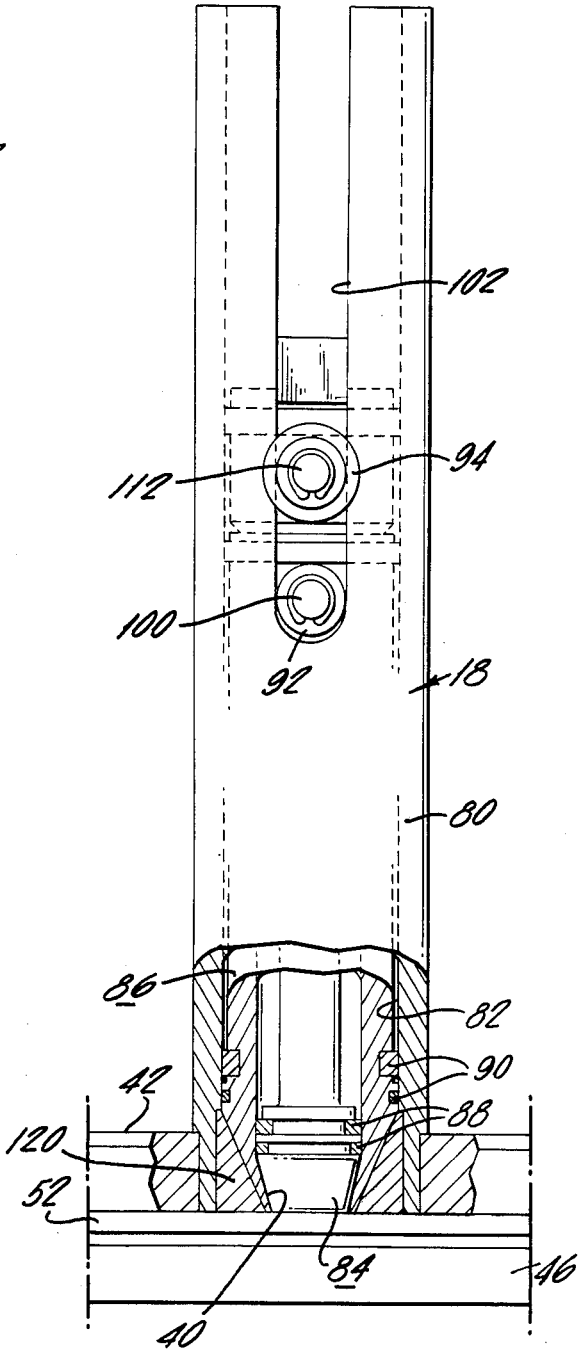
FIG. 8 is an elevational view of the piston and cylinder arrangement of FIG. 6, viewed at 90° to the view shown in FIG. 6 and with the two pistons in their most downward positions.

Upon leaving the arcuate sections, the lower ends of the filler chambers are closed off by the upper surface of the cover 52 of the filler table 46, along which they slide, until they reach the discharge station shown in FIG. 8, wherein the contents of the filler cylinders are discharged downwardly and into the open tops of the underlying axially indexed jars. The desired up-and-down motion of the pistons in the filler cylinders is controlled by cam wheels controlled by four cam rails, as will be described more fully hereinafter, to control the positions of the two pistons within each filler cylinder as the filler cylinders revolve.

Figure 6:
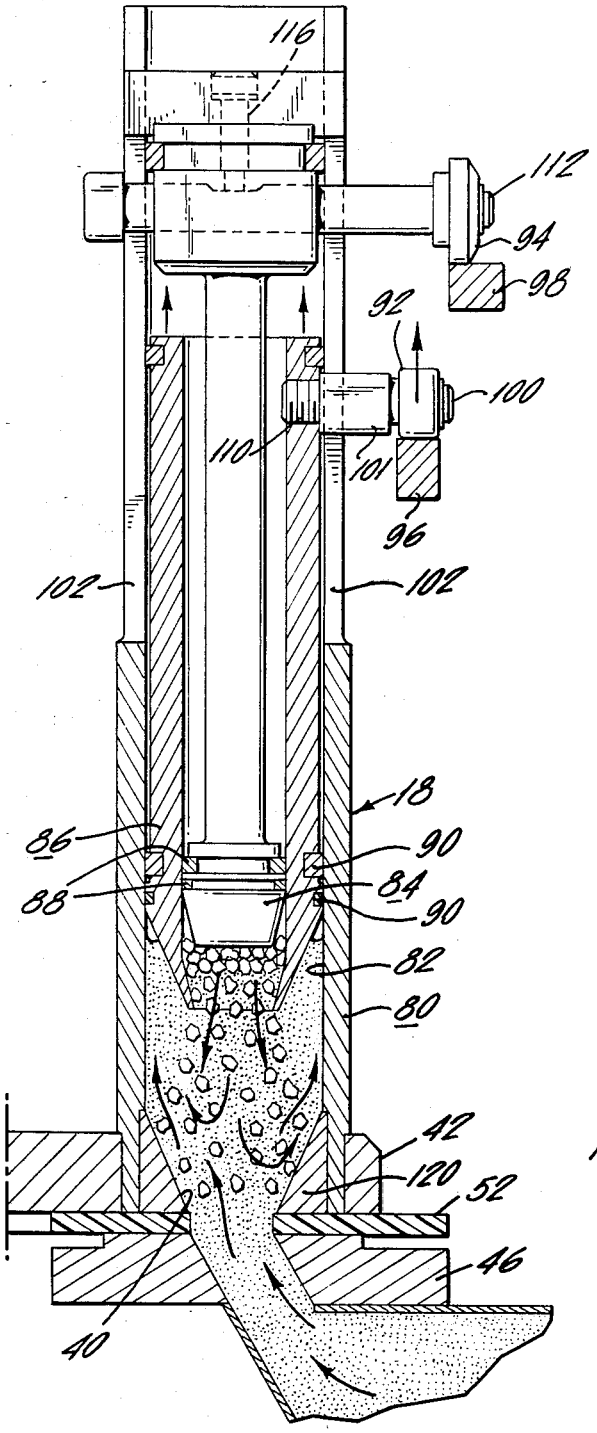
FIG. 6 is an enlarged elevational view, partly in section showing details of the double-piston cylinder and of the cam arrangement utilized in this embodiment of the invention to control the operation of the pistons, with the central piston fully elevated and the outer piston partly elevated.

Considering now especially FIGS. 6 and 8, showing a representative one of the filler cylinders, the fixed outer cylinder 80 defines within itself a main chamber 82 containing a central solid piston 84 and a hollow cylindrical piston 86, all coaxial with the axis of the outer cylinder 80. Appropriate O-rings 88 and 90 provide suitable seals extending respectively between the outside of the innermost piston and the inside of the cylindrical piston 86, and between the outside of the latter cylindrical piston and the fixed outer cylinder 80, to prevent leakage as the pistons are operated. Also shown in cross-section are the cam wheels 92 and 94, and the cam rails 96 and 98.

The lower cam wheel 92 is rotatably mounted on an axle 100, which is in turn mounted in a bushing 101 extending through a slot 102 in the side wall of the fixed outer cylinder 80 and secured at its opposite end to the cylindrical piston 86 by threads 110. Accordingly, when the cam wheel 92 moves upwardly or downwardly in its traversal of the cam rail 96, the outer cylindrical piston 86 moves up and down according to a defined and desired pattern of motion. A similar arrangement moves the solid inner piston 84 upwardly and downwardly in an appropriate fashion as the cam wheel 94 moves around its circular path on cam rail 98, wheel 94 being rotatably mounted on a shaft 112 which extends through the upper end of piston 84 and is held in position by a set-screw 116.

The lower ends of the inner and outer pistons are tapered inwardly at their lower ends so that when they are in their most downward positions they nest together and completely fill the opening at the lower end of the filler cylinder defined by the seat 120.

Figure 1:
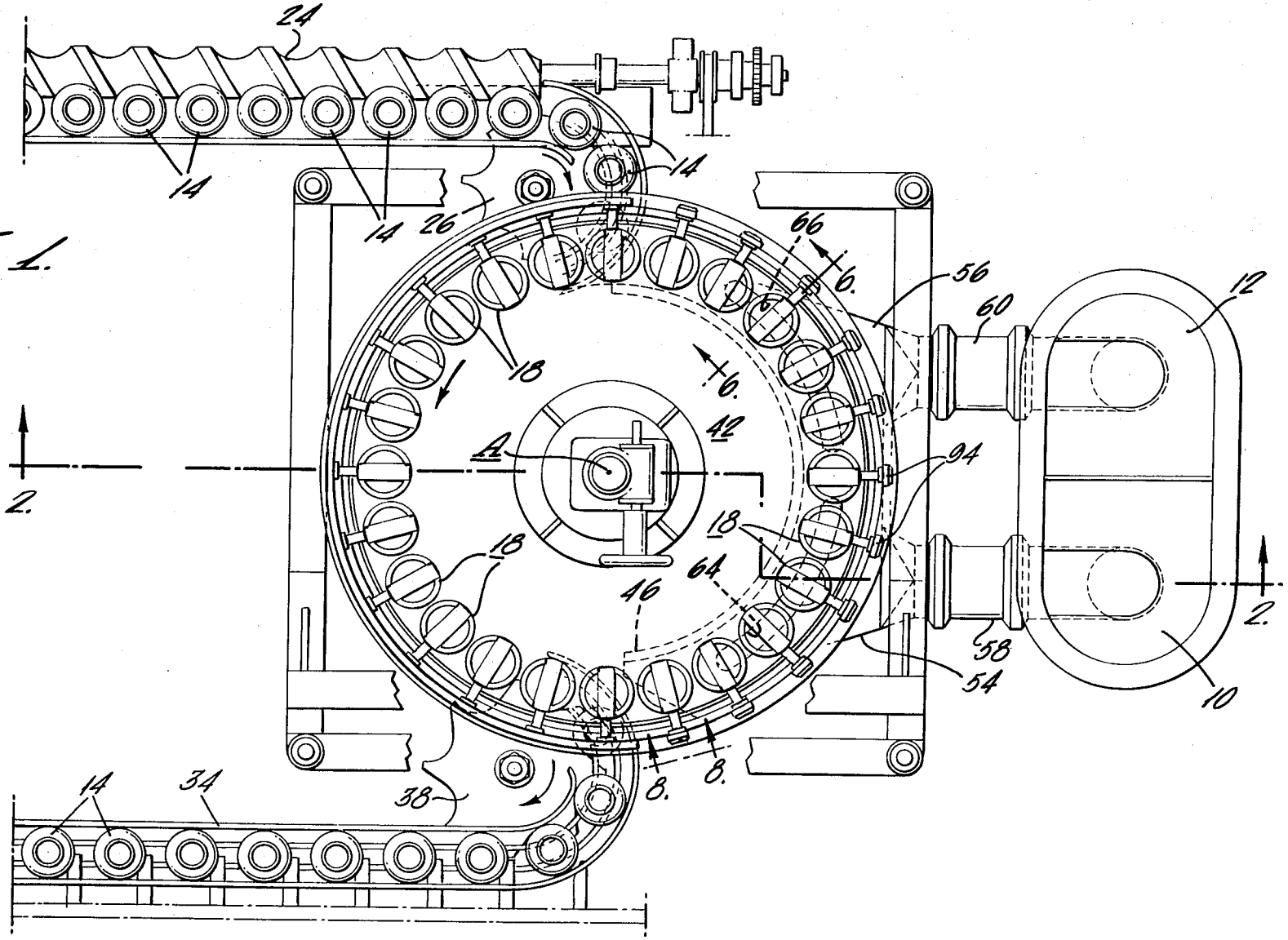
FIG. 1 is a plan view, and FIG. 2 a side elevational view with parts broken away, of portions of a volumetric filler embodying the present invention.
Figure 3A:
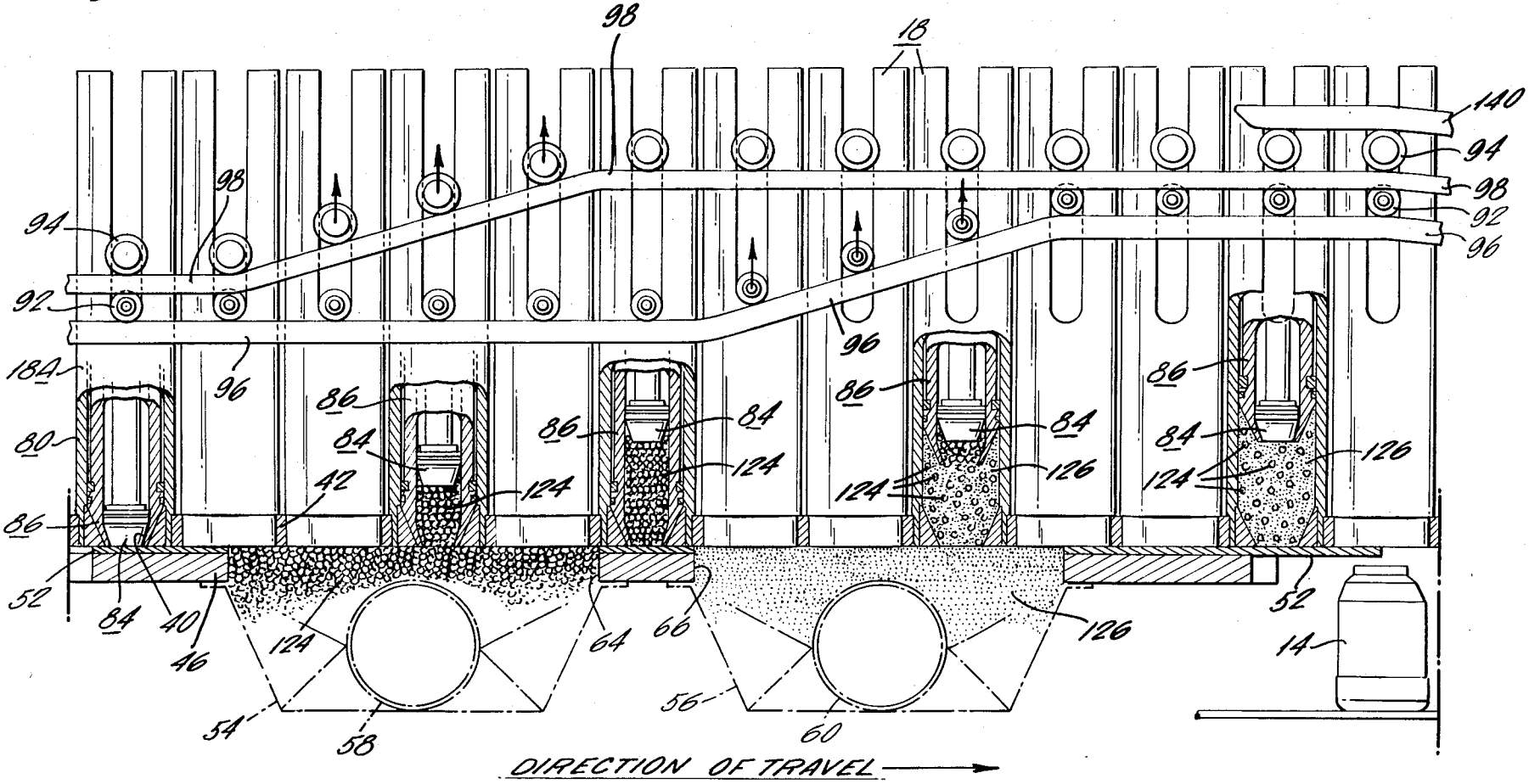
FIGS. 3A and 3B are enlarged side-elevational development views showing the filler cylinders and the positions of the pistons at different points in their travel around the volumetric filler machine.
Figure 3B:
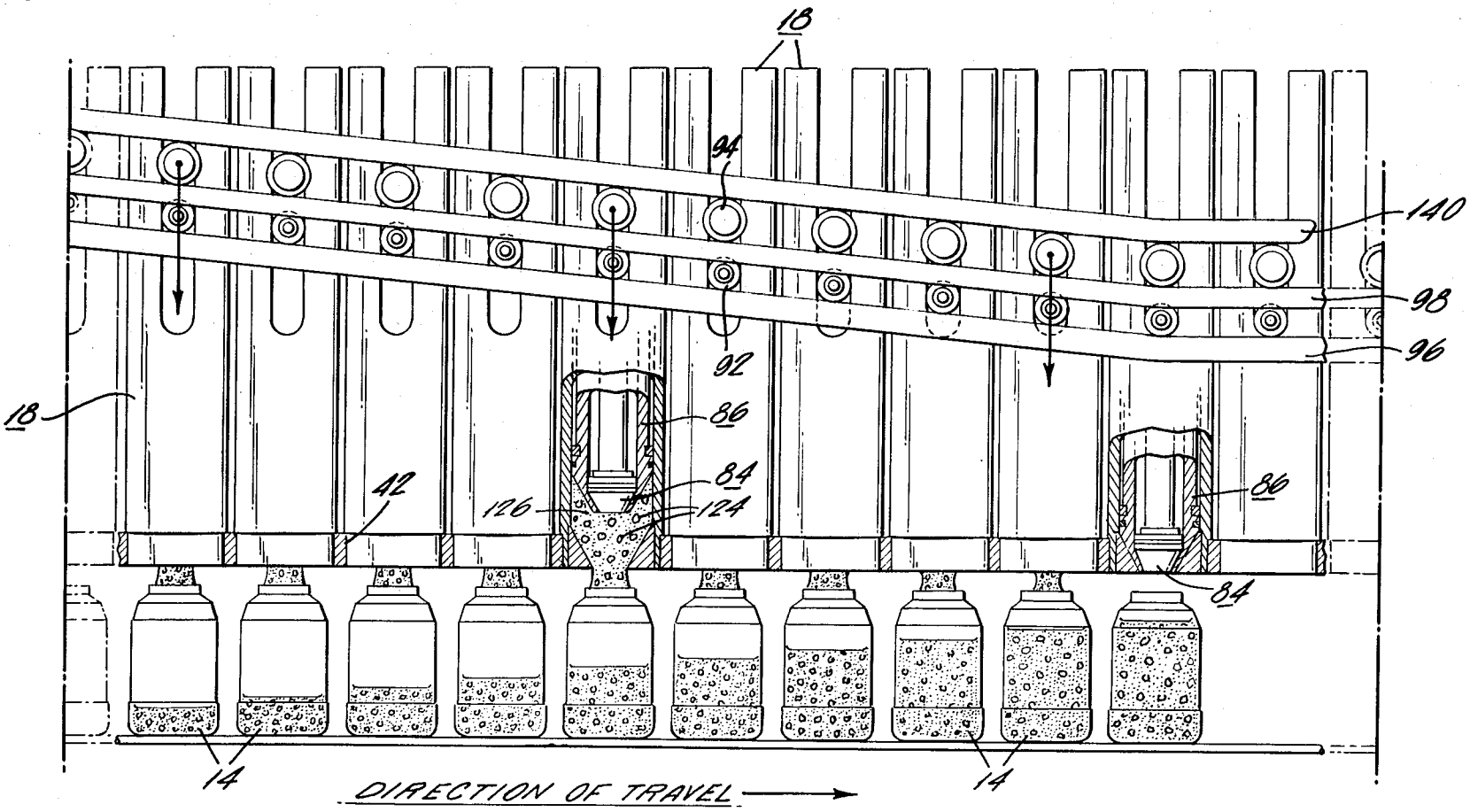

Referring to FIGS. 3A and 3B, the numbers across the top of these figures indicate successive positions around the volumetric filler apparatus corresponding to those similarly numbered on FIG. 1.

Referring to FIGS. 3A and 3B, there is shown at 0 the position of the filler cylinder 18A in which both the inner piston 84 and the outer cylindrical piston 86 are in their most downward positions and the lower opening 40 of the outer cylinder 80 is closed by the cover 52 on the underlying stationary filler table 46. These positions of the pistons 80 and 86 are determined by the positions of the lower and upper cam rails 96 and 98, acting through respective lower and upper cam wheels 96 and 98.

At position 1 the top rail 98 begins to ascend, causing the inner piston 84 to begin to rise as the lower opening 40 of cylinder 80 begins to overlap the arcuate opening 64. As soon as such overlap begins, the large-particle garnish 124 begins to flow upwardly into the space formerly occupied by the inner piston 84, in response to the partial vacuum thus produced and in response to any positive pressure head due to the flowable product in the hopper 10. At position there is shown a resultant accumulation of garnish 124 beneath piston 84. This action continues until the filler cylinder reaches position 5, where the top cam rail 98 ceases to rise and begins to run horizontally, and the lower opening 40 of the cylinder 80 has left its position above arcuate opening 64 and again is closed by the cover 52 on filler table 46. At position 5 the piston 84 is shown in its fully raised position, with a full load of large-particle garnish held beneath it in cylinder 80 as it slides along cover 52.

At position 8, the filler cylinder has moved into a position for which it is entirely above the supply chamber 56 for the small-particulate product 126, and cylindrical piston 86 has been raised by the upwardly-sloping cam rail 96 to bring the latter product into the space vacated by the rising cylindrical piston. As is shown, at this point some intermixing of the large and small-particle products occurs; this has occurred to an even greater degree at position 11, where the cylindrical piston and the inner piston are both at their highest positions, with the lower end of cylinder 80 again closed off by cover 52.

At position 12 the jars 14 begin to appear beneath the filler cylinders, as previously described, and at the end of position 12 cam rails 96 and 98 both begin to descend, parallel to each other, to lower both pistons 84 and 86 simultaneously and discharge the two products simultaneously into the jar, as shown in FIG. 3B—positions, 12–22. The downward motion of the corresponding cam wheels 92 and 94 is assured by placing cam rails 140 (see FIG. 2) just above cam wheels 92 and 94 to urge pistons 84 and 86 affirmatively downwardly during this phase of the cycle.

At position 22 both pistons have reached their lowermost positions, and both the small-particle product and the large-particle product have been completely discharged into the underlying jar. The downward stroke of the pistons produces some additional mixing action between the two products and, as delivered into the jar, they are substantially uniformly mixed together as desired, and without the undesired layering effect mentioned above.

It will be understood that each of the filler cylinders is constructed and operated as described for the exemplified filler cylinder of FIGS. 6 and 8, each successive filler cylinder discharging its contents into each corresponding successive jar as it reaches the discharge position in the filler.

The relative proportions and the absolute amounts of the two component products are adjustable by adjusting the relative and absolute lengths of stroke of the two pistons, which in turn are controlled by the positions and contours of the cam tracks, as will be understood.

In the example set forth above, the large-particle sauce is preferably at least 50% liquid sauce by volume to assist in its flow into the filler cylinders. In addition, it is preferred that the level of product in the hoppers be higher than the volumetric filler cylinders so that the vacuum action of the rising pistons in lifting product into the filler cylinders is aided by the positive pressure of the head of product in the hoppers.

If it is desired to dispense more than two component products, additional concentric piston cylinders may be utilized, one sliding over the other, together with corresponding additional numbers of sources of additional food components and openings placed at other angular positions along the filler table 46; one or more additional cam wheels and tracks will then also be provided to lift such additional cylinders at the appropriate times in passing over the corresponding product source openings, and to move all pistons downwardly at the discharge position when the jar is to be filled.

The invention is applicable to the dispensing of a large variety of types of products. As examples only, it may be used advantageously to dispense a mixture of two different liquids which are the same with respect to size of solid particles contained in them, or which are free of solid particles.

The apparatus utilized to perform the invention may differ substantially from that which has been specifically described and, accordingly, the scope of the invention is not to be limited by the foregoing detailed description but is instead defined by the appended claims.

What is claimed is:

1. Dispensing apparatus for taking a plurality of different component products from respective sources of said component products and for dispensing them as a composite product which is substantially homogeneous with respect to the distribution of said component products within it, comprising:

(a) a cylinder chamber and a plurality of concentric pistons therein, each independently reciprocable in said chamber along the axis thereof;

(b) a plurality of sources of a corresponding number of component products;

(c) motive means for moving one end of said cylinder chamber sequentially into communication with said plurality of sources;

(d) means for retracting said pistons into said cylinder sequentially and in synchronization with said moving of said end of said chamber, whereby each of said component products flows into said chamber in a predetermined amount;

(e) a product dispensing station, and means for moving said one end of said chamber to said product dispensing station, while said pistons remain retracted, thereby to carry said component products to said product dispensing station; and (f) discharge means for moving all of said pistons outwardly while said chamber is at said dispensing station, to discharge all of said component products together as a composite product.

2. The apparatus of claim 1, wherein the innermost one of said pistons is closed at its forward end, and the next outer piston is in the form of a hollow open-ended cylinder within which said innermost piston moves in sliding relation.

3. The apparatus of claim 2, in which each of said sources of said composite products comprises a product supply chamber and a filler table which overlies said supply chamber and has a feed opening therethrough communicating with the interior of said each feed chamber, said motive means being effective to move said one end of said cylinder along a path adjacent and communicating with said feed openings, said one end of said chamber having an opening the transverse dimension of which, normal to the direction of its motion, is substantially equal to the corresponding transverse dimension of said opening in said plate.

4. The apparatus of claim 1, wherein the innermost one of said pistons is the first of said pistons to be retracted to pick up component product.

5. The apparatus of claim 1, comprising a train of moving open-topped containers and means for moving said train in a circular pattern, and also comprising a plurality of said cylinder chambers each with a set of said concentric pistons therein, means for moving said cylinders in a circular path passing first over said plurality of sources of component products and then to said product dispensing station.

* * * * *